US005588236A

United States Patent [19]

Suzuki

[11] Patent Number: 5,588,236

[45] **Date of Patent: *Dec. 31, 1996**

[54] VISUAL PANEL

[75] Inventor: Teruo Suzuki, Urayasu, Japan

[73] Assignee: SCS Promotion Company Limited, Chiba, Japan

[ * ] Notice: The term of this patent shall not extend beyond the expiration date of Pat. No. 5,398,436.

[21] Appl. No.: 357,326

[22] Filed: Dec. 16, 1994

Related U.S. Application Data

[63] Continuation-in-part of Ser. No. 039,070, Apr. 8, 1993, Pat. No. 5,398,436.

[30] Foreign Application Priority Data

Oct. 25, 1991 [JP] Japan ..... 3-306627

[51] Int. Cl.[6] ..... G09F 13/00; G09F 17/00

[52] U.S. Cl. ..... 40/558; 40/604; 38/102.9; 160/399

[58] Field of Search ..... 40/603, 604, 605, 40/595, 558; 38/102.9; 160/399

[56] References Cited

U.S. PATENT DOCUMENTS

| | | |
|---|---|---|
| 2,338,297 | 1/1944 | Mugdan et al. . |
| 2,391,871 | 1/1946 | Benson . |
| 2,527,258 | 10/1950 | Kahn . |
| 2,647,261 | 8/1953 | Rassner . |
| 2,928,198 | 3/1960 | Madanick . |
| 3,276,512 | 10/1966 | Gallagher . |
| 3,461,584 | 8/1969 | Wilson . |
| 3,701,210 | 10/1972 | Smith . |
| 3,831,304 | 8/1974 | Miller et al. . |
| 3,995,715 | 12/1976 | Virtanen . |
| 4,107,826 | 8/1978 | Tysdal . |
| 4,369,591 | 1/1983 | Vicino . |
| 4,776,121 | 10/1988 | Vicino . |
| 4,800,947 | 1/1989 | Loomis . |
| 4,875,302 | 10/1989 | Noffsinger . |
| 4,878,303 | 11/1989 | Banniza et al. . |
| 4,894,888 | 1/1990 | Bassouls . |
| 4,976,057 | 12/1990 | Bianchi . |
| 5,020,254 | 6/1991 | Sheppard . |
| 5,140,765 | 8/1992 | King . |
| 5,398,436 | 3/1995 | Suzuki ..... 40/558 |

FOREIGN PATENT DOCUMENTS

| | | |
|---|---|---|
| 8012/61 | 2/1964 | Australia . |
| 36221/68 | 3/1970 | Australia . |
| 88485/82 | 3/1983 | Australia . |
| 11165/88 | 8/1988 | Australia . |
| 12339/88 | 9/1988 | Australia . |
| 1041268 | 10/1978 | Canada . |
| 1219111 | 3/1987 | Canada . |
| 1294752 | 1/1992 | Canada . |
| 0078391 | 5/1983 | European Pat. Off. . |
| 0132495 | 2/1985 | European Pat. Off. . |
| 0136400 | 4/1985 | European Pat. Off. . |
| 0294301 | 12/1988 | European Pat. Off. . |
| 0296863 | 12/1988 | European Pat. Off. . |
| 0389104 | 9/1990 | European Pat. Off. . |
| 2255448 | 3/1974 | France . |
| 2572832 | 5/1986 | France . |
| 2624062 | 6/1989 | France . |
| 2217826 | 10/1973 | Germany . |
| 2336733 | 2/1975 | Germany . |
| 2407552 | 8/1975 | Germany . |
| 2817210 | 11/1978 | Germany . |
| 3142829A1 | 5/1983 | Germany . |
| 3412064A1 | 10/1985 | Germany . |
| 51-42783 | 10/1976 | Japan . |
| 55-29454 | 2/1980 | Japan . |

(List continued on next page.)

*Primary Examiner*—Hoang Nguyen
*Attorney, Agent, or Firm*—Nixon & Vanderhye

[57] ABSTRACT

A visual panel comprising a flexible sheet having swollen portions at upper and lower edge portions thereof, respectively, a sheet stretching apparatus for slidably accommodating the swollen portions at the opposing edge portions of the sheet and for stretching the sheet over a frame, and a tension adjusting mechanism for adjusting a tension applied to the sheet.

2 Claims, 5 Drawing Sheets

FOREIGN PATENT DOCUMENTS

| | | |
|---|---|---|
| 57-66936 | 4/1982 | Japan . |
| 61-21367 | 2/1986 | Japan . |
| 63-115171 | 7/1988 | Japan . |
| 64-38672 | 3/1989 | Japan . |
| 1-229109 | 9/1989 | Japan . |
| 1-136975 | 9/1989 | Japan . |
| 287283 | 7/1990 | Japan . |
| 2-190890 | 7/1990 | Japan . |
| 1482687 | 8/1977 | United Kingdom . |
| 2226591 | 7/1990 | United Kingdom . |

VISUAL PANEL

RELATED APPLICATIONS

This application is a continuation-in-part of application Ser. No. 8/039,070, filed Apr. 8, 1993 now U.S. Pat. No. 5,398,436.

The present invention relates to a visual panel such as a lane decoration panel in a bowling alley, a display panel for outdoor-wall and rooftop advertizement, and a display panel for advertizement in station precincts.

In a bowling alley, for instance, a wall is used for a lifting device portion of an apparatus for automatically aligning and arranging bowling pins at a distal end of a lane so as to cover and conceal the lifting device portion from a competitor. Conventionally, the number of unknocked-down pins and the like are displayed on this wall by electric light.

Recently, the display of the number of unknocked-down pins and the like has come to be given on a table or the like on the competitor's side. Instead of the electric-light display of the number of unknocked-down pins and the like, a multiplicity of panels on which pictures, photographs or the like are printed have come to be installed on the walls for covering and concealing the lifting device portion, so as to create a unique, favorable atmosphere of the interior of the bowling alley from the viewpoint of vision.

In many cases, however, such panels on which pictures, photographs or the like are printed are periodically replaced with new panels on which different pictures, photographs or the like are printed, so as to renew the atmosphere of the interior of the bowling alley. Yet, since such panels have a size of approximately 3 m×1 m or thereabouts, much expense is required in the replacement operation, particularly in transportation, so that such panels are not necessarily satisfactory.

Such a problem is not restricted to panels in bowling alleys, and also occurs in the case of panels for rooftop advertizement which are periodically replaced.

The present invention has been devised in view of the above-described aspects, and its object is to provide a visual panel which facilitates transportation thereof and is thereby capable of reducing the replacement cost, and which is capable of desirably adjusting the tension applied to the sheet manually even if the sheet has large area, and is capable of maintaining a fine view.

BRIEF SUMMARY OF THE INVENTION

In accordance with the present invention, the aforementioned object is attained by a visual panel comprising: a frame; a flexible sheet having swollen portions at opposing edge portions thereof, respectively; and sheet stretching means for slidably accommodating the swollen portions at the opposing edge portions of the sheet and for stretching the sheet over the frame.

As a preferred example of the stretching means in accordance with the present invention, the stretching means comprises a first stretching device for slidably accommodating the swollen portion at one edge portion of the sheet and a second stretching device for slidably accommodating the swollen portion at the other edge portion of the sheet, wherein the first stretching device and the second stretching device are each provided with a hole for accommodating the swollen portion at the edge portion of the sheet and a slit through which the edge portion of the sheet continuing to the swollen portion is inserted. Here, in one example, at least one of the first stretching device and the second stretching device is secured to the frame or is disposed movably with respect to the frame. The frame and the stretching means may be formed of any of wood, metal, synthetic resin, and the like, but may preferably be formed of a hard plastic or aluminum, most preferably aluminum, in view of the mechanical strength or the light-weight characteristic.

In accordance with another aspect of the present invention, the visual panel further comprises tension adjusting means for adjusting a tension applied to the sheet. In the visual panel having such tension adjusting means in the present invention, it suffices if the first stretching device is secured to the frame, and the second stretching device is disposed movably with respect to the frame, wherein the tension adjusting means is provided between the second stretching device and the frame. In another form, it suffices if the first stretching device and the second stretching device are disposed movably with respect to the frame, wherein the tension adjusting means is disposed between the first stretching device and the second stretching device.

This tension adjusting means may be comprised of any of a ratchet-type lashing belt, a turnbuckle, a rubber band-type lashing belt, or a cam buckle-type lashing belt which are provided with hooks at both ends.

In accordance with the present invention, the aforementioned object is attained by a visual panel comprises: frame; a flexible sheet having swollen portion at opposing edge portions thereof, respectively; a sheet stretching means for slidably accommodating said swollen portions at said opposing edge portions of said sheet and for stretching said sheet over said frame; and tension adjusting means for adjusting a tension applied to said sheet; said stretching means comprising a first stretching device for accommodating said swollen portion at one edge portion of said sheet and a second stretching device for accommodating said swollen portion at the other edge portion of said sheet, said first stretching device and said second stretching device each being provided with a hole for accommodating said swollen portion at said edge portion of said sheet and a silt through which said edge portion of said sheet continuing to said swollen portion Is extended, said second stretching device being disposed movably with respect to said frame, said tension adjusting means comprising a rotatable arm rotatably installed in said frame, a screw having one end rotatably and pivotally connected to said rotatable arm, and a nut member threadedly fitted to a screw portion of said screw and rotatably Installed In said frame, said tension adjusting means being provided between said second stretching device and said frame.

The flexible sheet in the present invention may be a general sheet, such as a nylon sheet or a vinyl sheet obtained by extrusion molding, or a cloth or a nonwoven sheet formed of natural fibers or chemical fibers or a combination thereof. In a case where illumination is provided from the rear surface of the sheet, a back-lit type may preferably be used as the sheet. As the swollen portion of the sheet, it is possible to use one in which the edge portion of the sheet itself is made to swell by being integrally formed, or one which is obtained by tucking in the edge portion of the sheet itself. Furthermore, the swollen portion may be one in which the edge portion is turned up and sewn together, and a flexible rope is inserted into a loop formed therein. The cross-sectional configuration of this swollen portion may be a circular, triangular, quadrangular, or other polygonal shape. The flexible sheet may preferably be slightly stretchable, but if it is excessively stretchable, there are cases where the picture or the like formed by printing or the like is distorted.

As a screw of the tension adjusting means of the present Invention, a bolt having a hexagonal head member is preferably used, and a wing nut or a bolt having hexagonal recess in the head portion may also be used, in short, it is favorable that a means for rotating the screw is disposed at the head portion which is formed at one end of the screw.

In accordance with the visual panel of the present invention, a picture, a photograph or the like is printed in advance on the flexible sheet. This sheet is stretched over the frame by using the stretching means, and is mounted in, for instance, a bowling alley or the like. When it is desirous to change the atmosphere of the interior of the bowling alley, the sheet is removed from the frame, and a sheet with a new different picture, a photograph or the like printed thereon is stretched over the frame. At that time, if the new and old sheets are transported in a rolled-up state, the operation does not take up much space and is facilitated remarkably.

In accordance with the visual panel of the present invention, since the portion where a picture, a photograph or the like is printed is the flexible sheet and is arranged to be removable, replacement and transportation thereof are very easy. As a result, the operating efficiency is improved remarkably, and the replacement cost can be reduced.

Furthermore, the rotatable arm is rotated by rotating the screw of the tension adjusting means, thereby stretching the sheet tautly.

Hereafter, a more detailed description of the present invention will be given on the basis of specific examples shown in the drawings. Hence, the above-described invention and other aspects of the invention will become more apparent. It should be noted that the present invention is not restricted to these specific examples.

DETAILED DESCRIPTION

Figure 1:
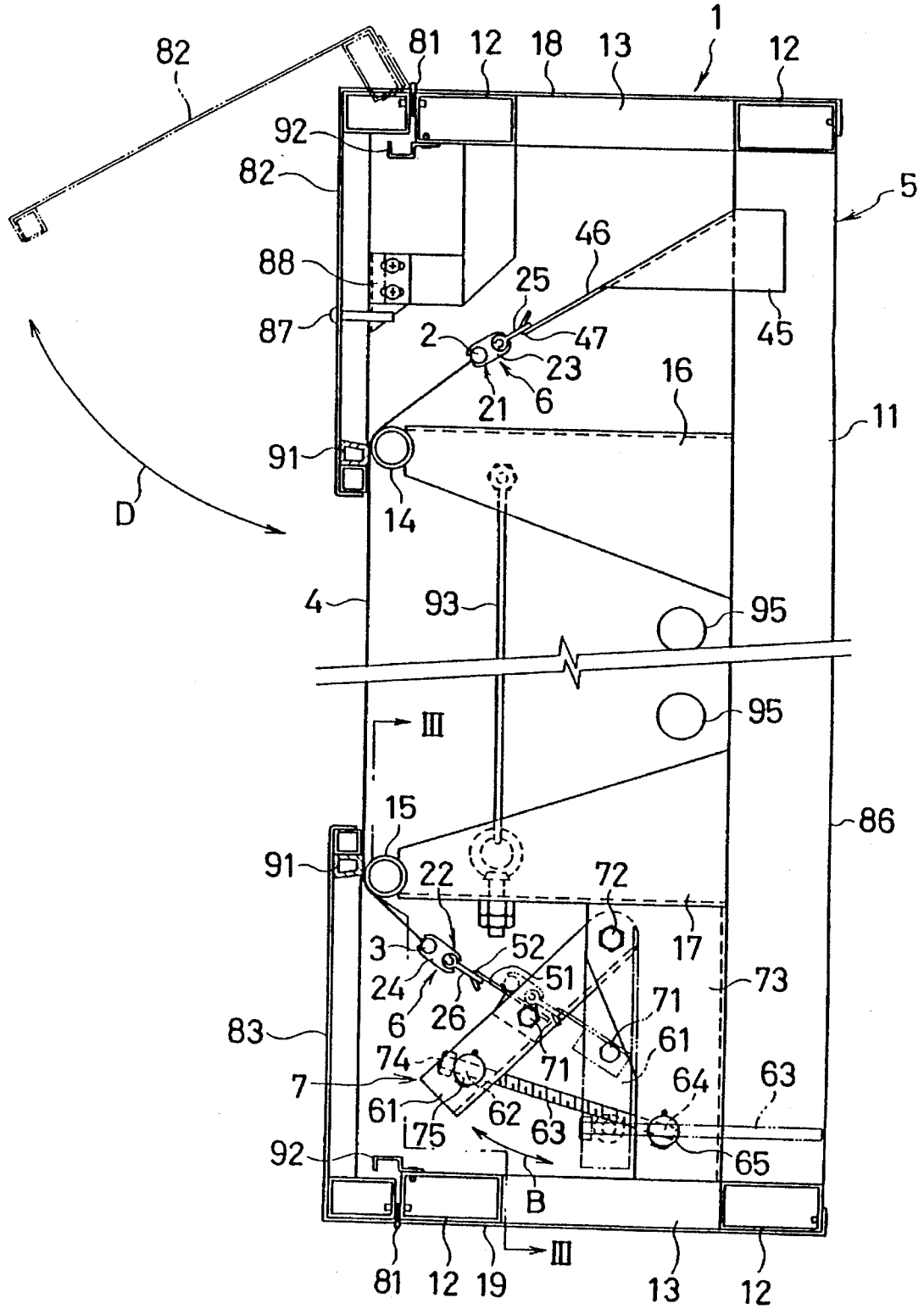
FIG. 1 is a cross-sectional view of a preferred embodiment of the present invention.
Figure 2:
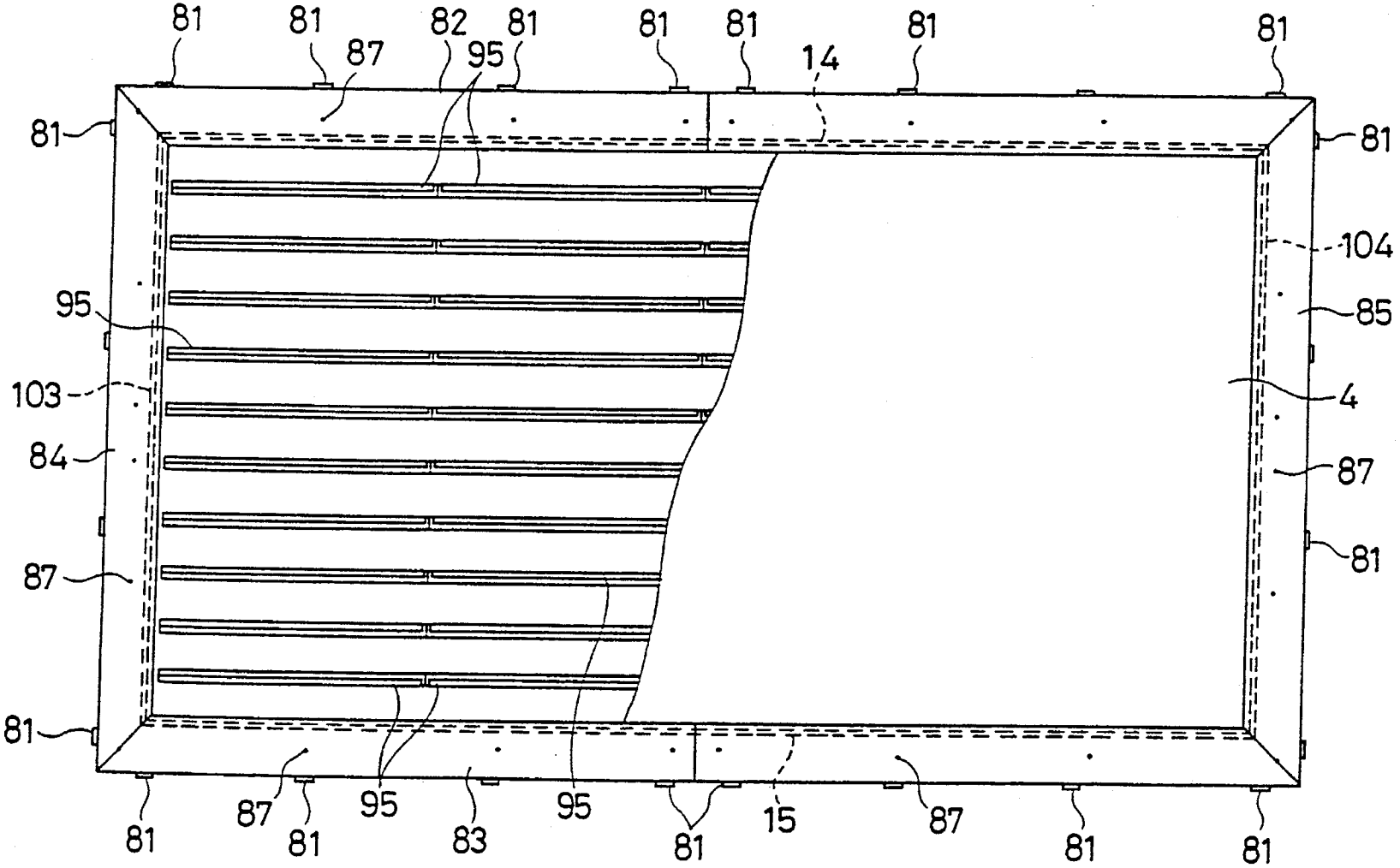
FIG. 2 is a front view of the embodiment shown in FIG. 1.
Figure 3:
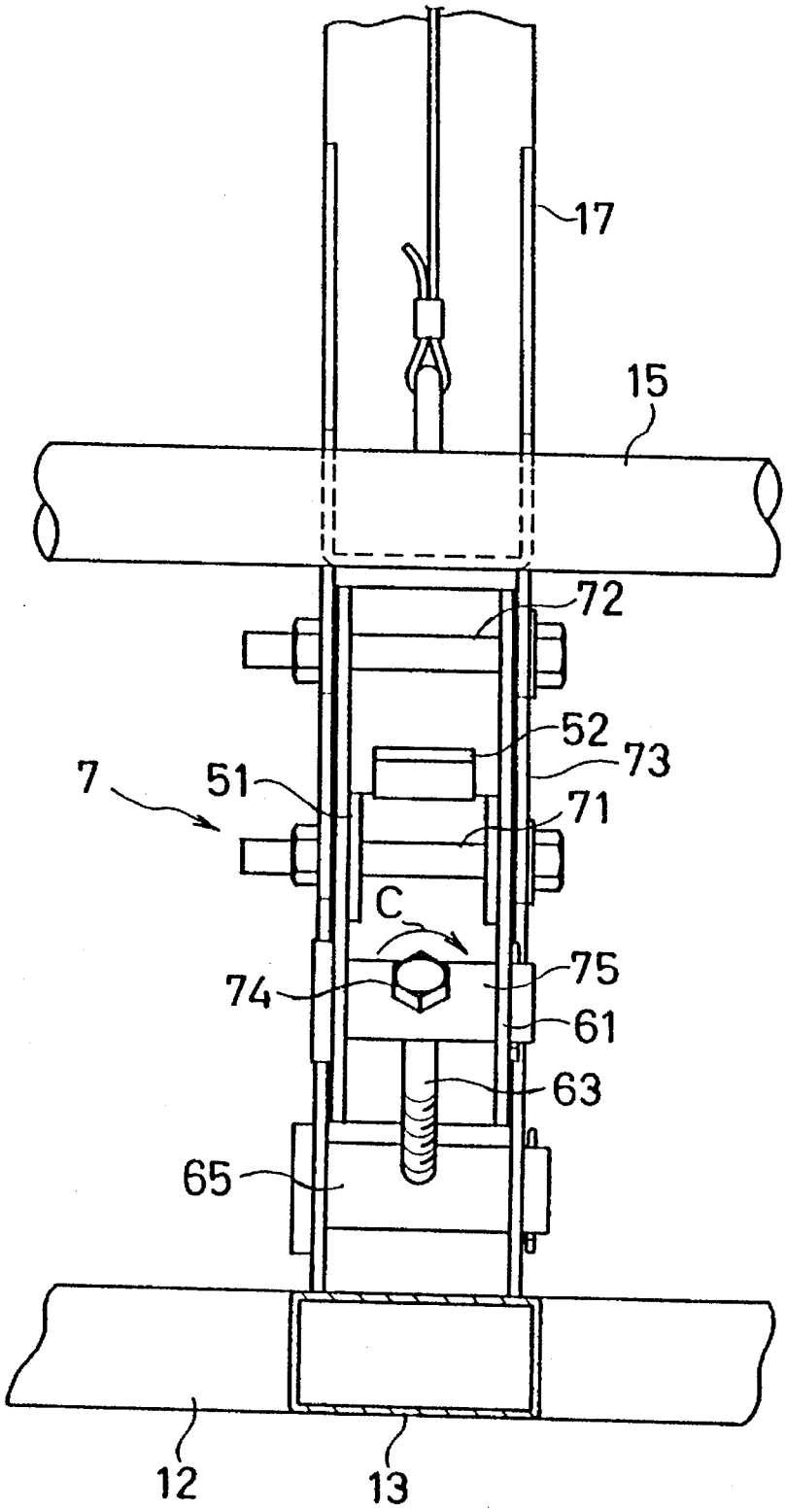
FIG. 3 is a sectional view at III—III line shown in FIG. 1.
Figure 4:
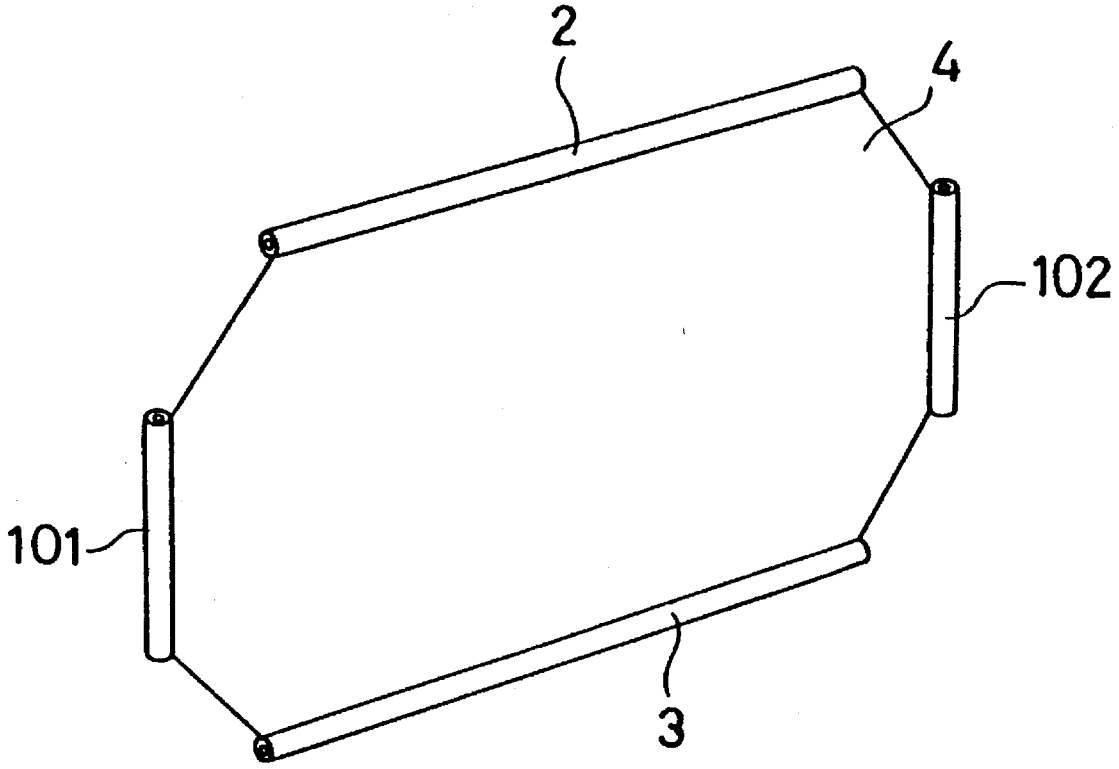
FIG. 4 is a perspective view of the sheet of the embodiment shown in FIG. 1.
Figure 5:
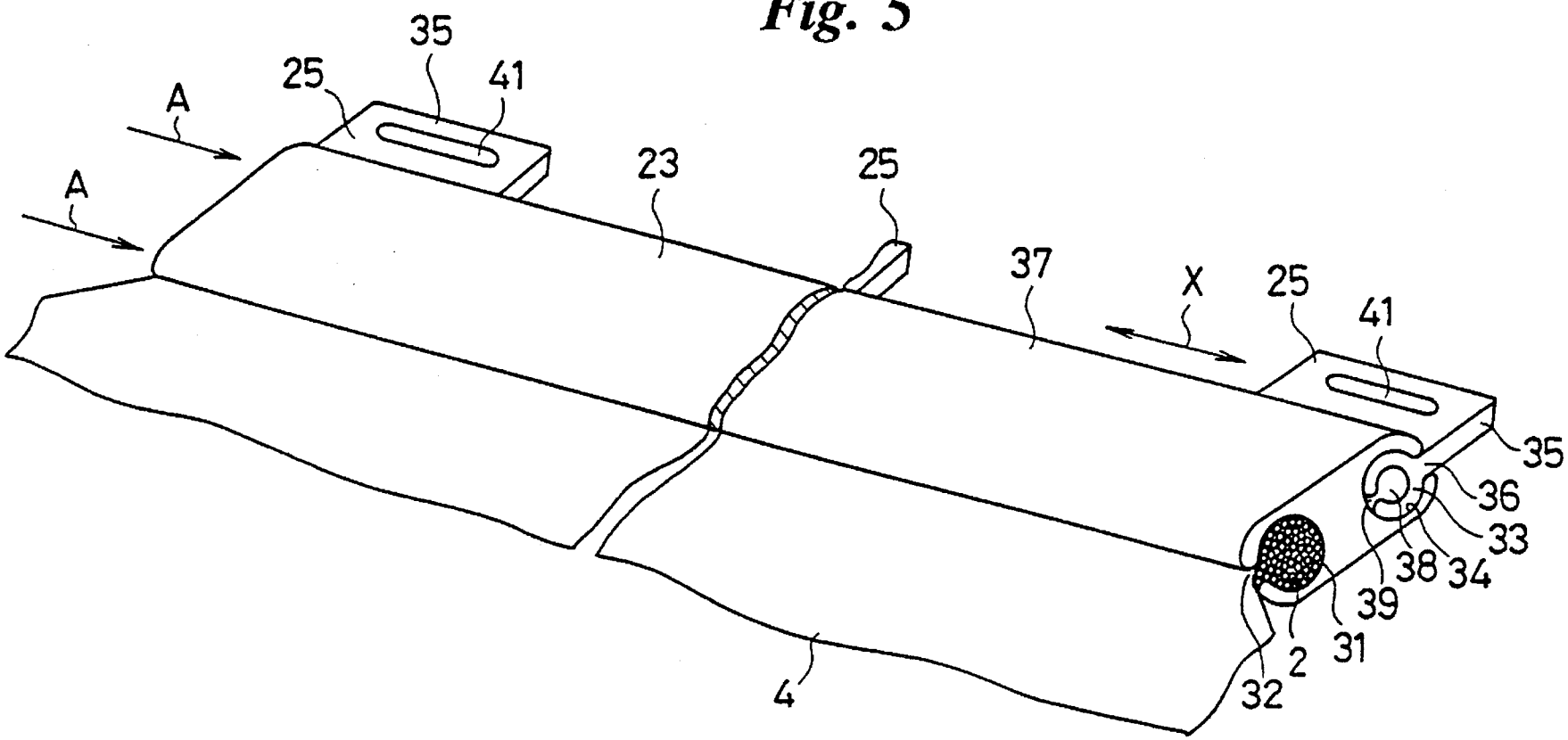
FIG. 5 is perspective view of the connector and the like used in the embodiment shown in FIG. 1.

In FIGS. 1 to 5, a visual panel I in this embodiment comprises a flexible sheet 4 having swollen portions 2 and 3 at upper and lower edge portions thereof, respectively, a sheet stretching means 6 for slidably accommodating the swollen portions 2 and 3 at the opposing edge portions of the sheet 4 and for stretching the sheet 4 over a frame 5, and a tension adjusting means 7 for adjusting a tension applied to the sheet 4.

The frame 5 in this embodiment has a plurality of vertical members 11, a plurality of transverse members 12, a plurality of horizontal members 13 and hollow cylindrical members 14 and 15. The hollow cylindrical members 14 and 15 are secured to one end of brackets 16 and 17 by means of welding or the like, the brackets 16 and 17 having the other end secured to the vertical member 11 by means of welding or the like. The hollow cylindrical members 14 and 15 are supported by the vertical members 11 via the brackets 16 and 17 in such a manner that the support is performed in plural portions so as not to make the hollow cylindrical members 14 and 15 bend. The vertical members 11, the transverse members 12 and the horizontal members 13 are secured to each other by welding or the like such that the frame 5 is formed in generally box shape, and the outside of the upper and lower transverse members 12 and horizontal members 13 are fitted or secured with covers 18 and 19 by means of screws or the like so as to be covered with them. The side of the frame 5 is also secured with the cover (not shown) similar to the covers 18 and 19.

In the stretching means 6 in this embodiment, a first stretching device 21 for accommodating the swollen portion 2 at one edge portion of the sheet 4 and a second stretching device 22 for accommodating the swollen portion 3 at the other edge of the sheet 4 comprises connectors 23 and 24 and a plurality of adjusters 25 and 26, respectively. Each connectors 23 and 24 is identically Formed, and also each adjusters 25 and 26 is identically formed, hence a description will be given of only the connector 23 and adjuster 25.

The longitudinal connector 23 comprises a hole 31 for accommodating the swollen portion 2 at one edge portion of the sheet 4, a slit 32 through which the edge portion of the sheet 4 continuing to the swollen portion 2 is extended, a hole 34 for slidably accommodating a swollen portion 33 of the adjuster 25 and a slit 36 through which plate-like portion 35 of the adjuster 25 continuing to the swollen portion 33 is extended. The holes 31 and 34 and the slits 32 and 36 are disposed in such a manner as to extend over the overall length of a base portion 37. Each adjusters 25, as described above, comprises the swollen portion 33, wherein a hollow portion 38 and a slit 39 communicating with the hollow portion 38 are formed, and the plate-like portion 35 integrally formed with the swollen portion 33, the portion 35 being formed a longitudinal hole 41.

The swollen portions 2 and 33 are inserted into the holes 31 and 34 in the horizontal direction, that is, in the direction A. As a result that the swollen portion 33 is slidably accommodated by the hole 31, each adjusters 25 is capable of adjusting position with respect to the connector 23 in the direction X, that is, the longitudinal direction of the connector 23. At the longitudinal hole 41 of the adjuster 25, a hook portion 47 of a fixing connector 46 having one end 45 secured to the vertical member 11 by means of welding or the like is retained, thus the stretching device 21 is connected to the frame 5. In the fixing connector 46, the portion between one end 45 and the hook portion 47 may be formed by means of coil spring. At a longitudinal hole (not shown) of the plate-like portion of the adjuster 26 formed in the same way as the adjuster 25, a hook portion 52 of a connector 51 of the tension adjusting means 7 is retained.

The swollen portions 2 and 3 in this embodiment are formed such that the edge portion off the sheet 4 is turned up and sewn together, and a flexible rope is inserted into a loop formed therein.

The tension adjusting means 7 comprises a rotatable arm 61 rotatably attached to the frame 5 in the direction B, a screw 63 having one end 62 rotatably and pivotally connected to the rotatable arm 61 and a nut member 65 wherein a screw portion 64 of the screw 63 is threadedly fitted to the nut member 65 rotatably attached to the frame 5, and the tension adjusting means 7 is disposed between the stretching device 22 and the frame 5. The connector 51 having the hook portion 52 is rotatably attached to the rotatable arm 61 via a pin 71, the rotatable arm 61 is rotatably attached to a bracket 73 of the frame 5 via a pin 72, the bracket 73 is secured to the vertical member 11 by means of welding or the like, the screw 63 comprised of a bolt having a hexagonal head portion 74 in this embodiment is disposed such that one end 62 of the screw 63 is rotatably passing through a shaft 75, which is rotatably attached to the rotatable arm 61, and the cylindrical nut member 65 is rotatably supported by the bracket 73. Consequently, the rotatable arm 61 can be rotated toward the bracket 73 by threadedly inserting the screw portion 64 into the nut member 65 by rotating the hexagonal head portion 74 of the screw 63 in the direction C by means of a tool such as a nut driver or the like, thus the sheet 4 is stretched tautly by stretching one end of the sheet 4 via the connector 51.

A plurality of the tension adjusting means 7 are disposed in the horizontal direction in the same way as the adjusters 25 and 26 and the fixing connector 46.

The visual panel 1 in this embodiment further comprises an upper edge cover 82, a lower edge cover 83, a left edge cover 84 and a right edge cover 85 rotatably attached to the frame 5 in the direction D via a plurality of hinges 81, and a back board 86. The upper edge cover 82, the lower edge cover 83, the left edge cover 84 and the right edge cover 85 each is formed so as to be fixed to a cover support member 88 of the frame 5 by a screw 87, consequently, the upper edge cover 82, the lower edge cover 83, the left edge cover 84 and the right edge cover 85 can be rotated in the direction D centering around the hinge 81, respectively. The inner peripheral edge of each the upper edge cover 82, the lower edge cover 83, the left edge cover 84 and the right edge cover 85 is adhered with a pad 91 which clamps the sheet 4 in cooperation with the hollow cylindrical members 14 and 15, and smooths out a few wrinkles or the like which may be occurred on the sheet 4 so as to prevent the occurrence of those wrinkles. When the upper edge cover 82, the lower edge cover 83, the left edge cover 84 and the right edge cover 85 are closed, they are supported by the cover support member 88 attached to the transverse member 12 or the like. In this embodiment, the upper edge cover 82 and the lower edge cover 83 are divided into two parts as they are long. Between the upper edge cover 82, the lower edge cover 83, the left edge cover 84 and the right edge cover 85, and the frame 5, a U-shaped member 92 for preventing the entrance of rainwater is disposed in such a manner as to be supported by the Frame 5. In the visual panel 1 in this embodiment, a plurality of fluorescent lamps 95 as illuminating devices are attached to the frames 5 via an appropriate bracket. The sheet 4 is illuminated from the rear by the lighting of the fluorescent lamps 95, thereby obtaining favorable effect on a display for advertisement, especially at night. Between the brackets 16 and 17, a reinforcing wire 93 is stretched, and the reinforcing wire 93 maintains a regular distance between the hollow cylindrical members 14 and 15, thereby preventing the breakage of the sheet 4 due to the deflection of the frame 5 caused by wind.

The visual panel formed as described above is installed, for instance, on the rooftop or on the wall of a building via an appropriate support device. In the visual panel 1, the upper cover 82 and the lower cover 83 are rotated in the direction D by removing the screw 87, then the tension of the sheet 4 is eased by loosening the screw 63, and the swollen portions 2 and 3 are pulled out of the connectors 23 and 24, thereby replacing the sheet 4 easily. The large sheet 4 can easily be set up in a tense state by rotating the screw 63 in the direction C by means of a tool or the like.

In the visual panel i in this embodiment, the same structures as that of the sheet stretching means 6 and the tension adjusting means 7 are applied to swollen portions 101 and 102 at both left and right edges of the sheet 4, and the sheet 4 is stretched tautly with respect to the horizontal direction between hollow cylindrical portions 103 and 104 disposed on the frame 5 in the same way as the hollow cylindrical portions 14 and 15.

Although, in the above described embodiment, the sheet is provided only on one side of the frame, the sheet may be provided on both sides of the frame, in which case, illuminating devices may also be provided between the respective sheets and the frame. Furthermore, the visual panels may be arranged in the shape of a prism, e.g., a quadrangular prism, and casters may be provided at the lower ends of the visual panels so as to render the visual panels movable.

What is claimed is:

1. A visual panel comprising:

a frame;

a flexible sheet having swollen portions at opposing edge portions thereof, respectively;

sheet stretching means for slidably accommodating said swollen portions at said opposing edge portions of said sheet and for stretching said sheet over said frame; and tension adjusting means for adjusting a tension to be applied to said sheet;

said stretching means comprising a first stretching device for accommodating one of said swollen portion portions at one edge portion of said sheet and a second stretching device for accommodating another of said swollen portions at the other edge portion of said sheet;

said first stretching device and said second stretching device each being provided with a hole for accommodating said swollen portions at said edge portions, respectively, of said sheet and a slit through which said edge portion of said sheet continuing to said swollen portion is extended, said second stretching device being disposed movably with respect to said frame, said tension adjusting means comprising a rotatable arm rotatably mounted on said frame by means of a pivotal pin, a screw having one end rotatably and pivotally connected to said rotatable arm, and a nut member threadedly fitted to a screw portion of said screw and rotatably mounted on said frame, said tension adjusting means being provided between said second stretching device and said frame.

2. A visual panel according to claim 1, wherein said first stretching device is secured to said frame.

* * * * *